US006160233A

United States Patent [19]

Hu

[11] Patent Number: 6,160,233

[45] Date of Patent: Dec. 12, 2000

[54] KEY STRUCTURE OF COMPUTER KEYBOARD

[75] Inventor: Gino Hu, Taipei, Taiwan

[73] Assignee: Silitek Corporation, Taipei, Taiwan

[21] Appl. No.: 09/215,542

[22] Filed: Dec. 18, 1998

[51] Int. Cl.[7] ..... H01H 13/70

[52] U.S. Cl. ..... 200/344; 200/341

[58] Field of Search ..... 200/341–344, 200/512–517

[56] References Cited

U.S. PATENT DOCUMENTS 5,823,325 10/1998 Lin ..... 200/344
5,878,872 3/1999 Tsai ..... 200/344
5,973,281 10/1999 Tsai ..... 200/344

*Primary Examiner*—Michael L. Gellner
*Assistant Examiner*—Nhung Nguyen
*Attorney, Agent, or Firm*—Rosenberg, Klein & Lee

[57] ABSTRACT

A key structure of computer keyboard having a base, a conductive film, an elastic member, a frame, a cap. A plurality of coupling parts are arranged on the cap and the base, wherein the coupling part on along the same side of the cap and the base are composed of a sliding groove and three fixed grooves. The frame has a plurality of pivoting shafts arranged within the sliding grooves and fixed groove such that the frame can be pressed down. Both sides of the elastic member are fixed between the cap and the conductive film such that the elastic member will not outleap. A clamping device is arranged between the cap and the base such that the key will not shake when being pressed.

7 Claims, 6 Drawing Sheets

KEY STRUCTURE OF COMPUTER KEYBOARD

FIELD OF THE INVENTION

The present invention relates to a key structure computer keyboard, especially to a key structure of computer keyboard having a base, a conductive film, an elastic member, a frame, a cap, one sliding groove and three fixed grooves on the same side, a sliding groove on the center arm of the frame whereby the key will not shake when being pressed.

BACKGROUND OF THE INVENTION

The keys 20 in a conventional keyboard, as shown in FIG. 8, comprises a metal base 81, a conductive film 82, a plastic plate 83, an elastic member 84, a frame 85 and a cap 86. Moreover, corresponding coupling part 811 and 861 are arranged on the metal base 81 and the cap 86, respectively. The frame 85 comprises a first rack 851 and a second rack 852 pivotably connected to each other. Two locking part 853 and 854 corresponding to the coupling part 811 and 861 of the metal plate 81 and cap 86 are arranged on the first rack 851 and the second rack 852, respectively, whereby the cap 86 moves upward and downward.

However, the conventional keys 20 lie on the elastic member 84 and have no supporting elements on lateral sides thereof. The keys 20 are wont to shake when being pressed.

Therefore, it is the object of the present to provide a key structure of computer keyboard which does not shake when being pressed.

It is another object of the invention to provide a key for computer keyboard the elastic member thereof will not outleap when the key is opened for repair.

It is still another object of the invention to provide a key for computer keyboard which does not employ conventional-used plastic plate, thus simplifying the assemble.

To achieve above objects, the present invention provide a key structure of computer keyboard having a base, a conductive film, an elastic member, a frame, a cap. A plurality of coupling parts are arranged on the cap and the base, wherein the coupling part on along the same side of the cap and the base are composed of a sliding groove and three fixed grooves. The frame has a plurality of pivoting shafts arranged within the sliding grooves and fixed groove such that the frame can be pressed down. Both sides of the elastic member are fixed between the cap and the conductive film such that the elastic member will not outleap. A clamping device is arranged between the cap and the base such that the key will not shake when being pressed.

The various objects and advantages of the present invention will be more readily understood from the following detailed description when read in conjunction with the appended drawing, in which:

DETAILED DESCRIPTION OF PREFERRED EMBODIMENT

Figure 1:
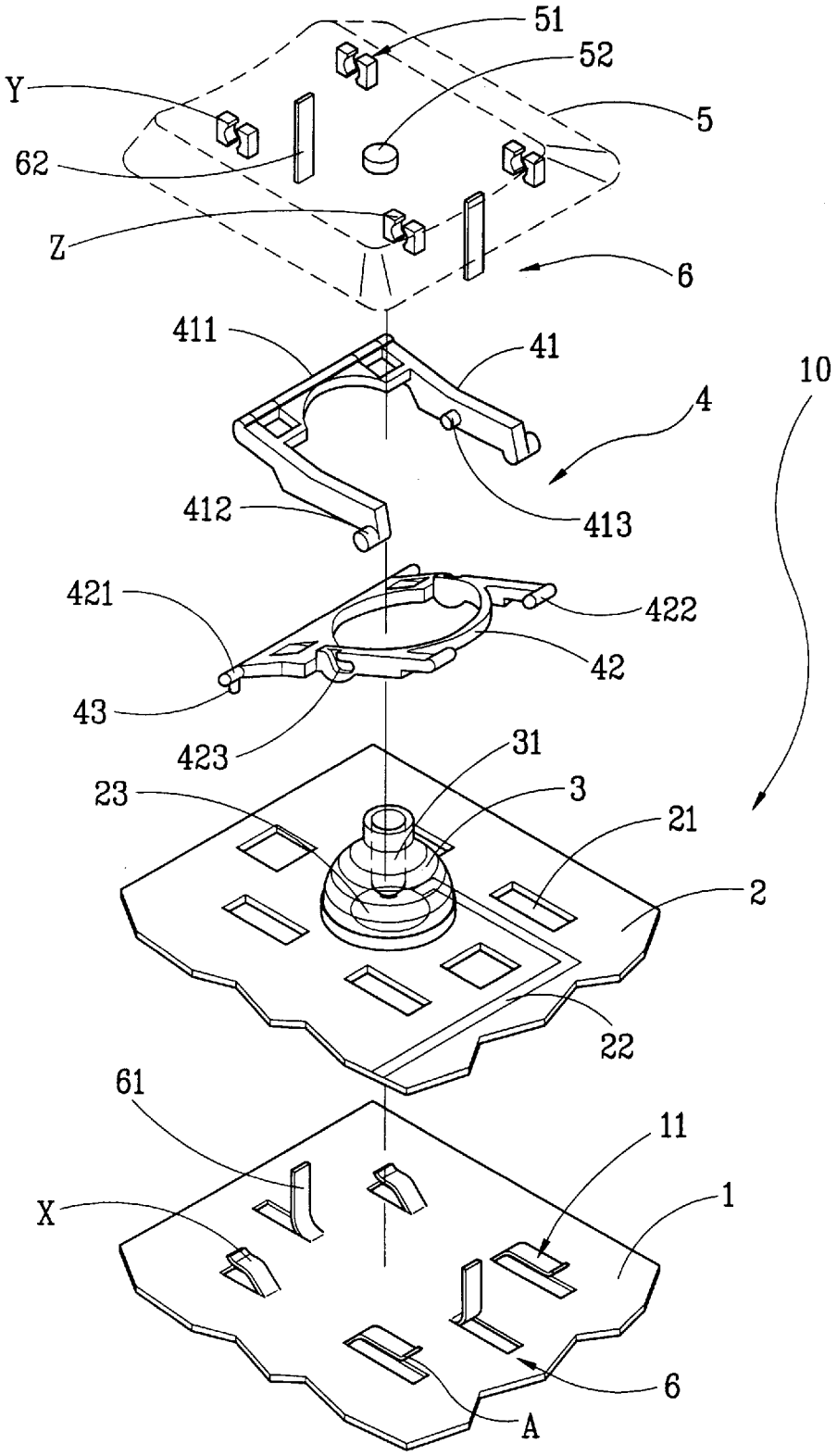
FIG. 1 is an exploded view of the present invention.

As shown in FIG. 1, the inventive key 10 comprises a base 10, a conductive film 2, an elastic member 3, a frame 4 and a cap 5. Moreover, four coupling parts 11, 51 are arranged on the bases 1 and cap 5, respectively. The coupling parts 11 and 51 along the same side of the base 1 and cap 5 are composed of a sliding groove A, and three fixed grooves X, Y and Z. In this preferred embodiment, the sliding groove A is arranged on the right side of the base 1.

Figure 2:
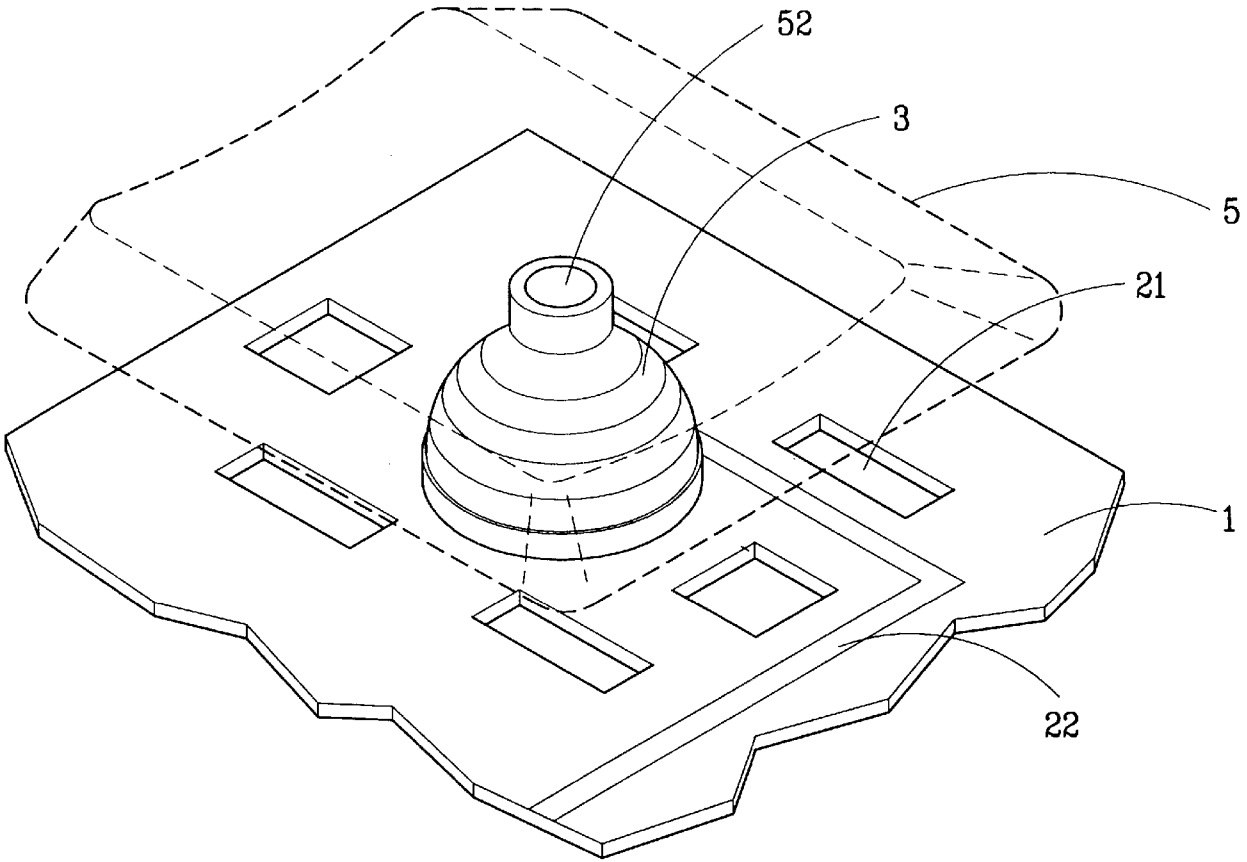
FIG. 2 show the state of the elastic element attached between the cap and the conductive film according to the present invention.

The conductive film 2 is arranged upon the base 1 and has an opening 21 corresponding to the coupling part 11 of the base 1 such that the coupling part 11 projects from the opening 21 when the conductive film 2 is put upon the base 1. The conductive film 2 is provided with circuit 22 and electric contact 23. As shown in FIG. 2, the elastic member 3 is placed between the conductive film 2 and the bump 52 of the cap 5. The elastic member will be pushed down when the cap 5 is pressed, and at this time, the conductive pin 31 of the elastic member 3 is in contact to the elastic contact 23 of the conductive film 2.

Figure 3A:
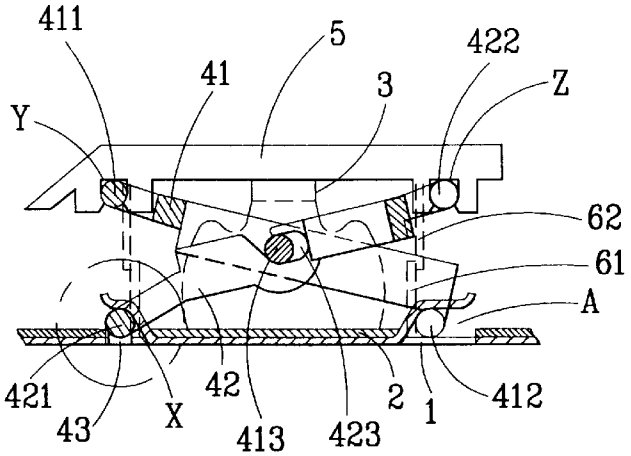
FIG. 3 is a cross-section view showing an embodiment of the present invention.
Figure 3B:
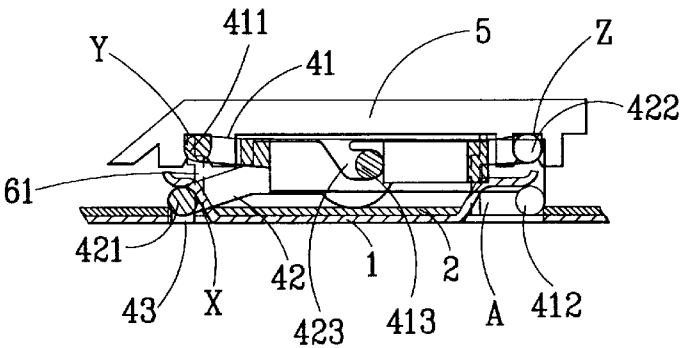

As shown in FIGS. 1 and 3, the frame 4 comprises a first rack 41 and a second rack 42 which are pivotably connected. The width of first rack 41 is slightly larger than that of the second rack 42 such that the first rack 41 can be pivotably arranged on the outer side of the second rack 42. The first rack 41 is of a U-shape and has a shaft 411 on the closed end thereof, and engaged into the two fixing groove Y on the left side of the cap 5, and poles 412 extending on the opened end of the first rack 41 and engaged into the sliding groove A on the right side of the base 1. Moreover, the first rack 41 has tie 413 projecting on the center part of its arms. Both sides of the second rack 42 are provided with pivoting shaft 421 and 422 engaged within the fixed groove X on left side of the base 1 and the fixed groove Y on the right side of the cap 5. Moreover, the second rack 42 has a engaging groove 423 corresponding to the tie 413 of the first rack 41 such that the tie 413 can be pivotably arranged within the engaging groove 423.

Figure 4:
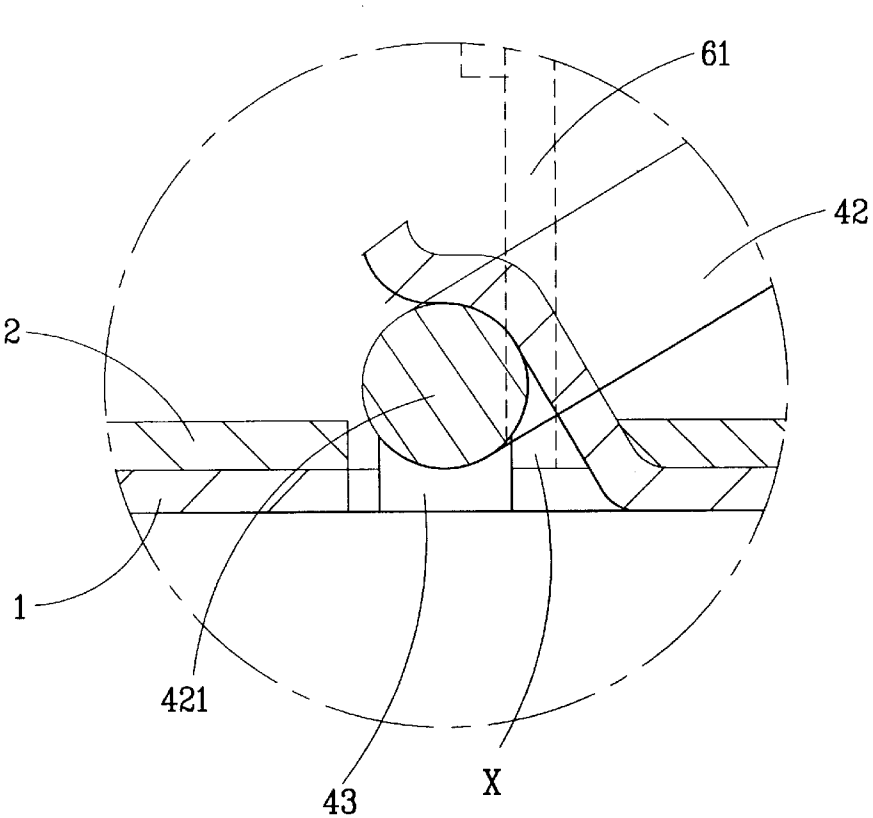
FIG. 4 is a partially enlarged view of the FIG. 3

With reference now to FIGS. 1 and 4, when the coupling part 11 on the base 1 is functioned as a fixed groove X, Y or Z, a blocking pole 43 extends downward from the pivoting shaft 412 of the first rack 41 or the pivoting shaft 421 of the second rack 42 such that the pivoting shaft 412 or 421 can be prevented from releasing out of the fixed groove X, Y or Z of the base 1. As shown in FIG. 1, the fixed groove X is provided on the left side of the base 1, therefore, the pivoting shaft 421 of the second rack 42 is provided with downward extending blocking pole 43.

As shown in FIG. 1, a clamping means is provided between the base 1 and the cap 5 wherein the clamping means 6 comprises a first blocking plate 61 on the left and right side of the base 1, respectively, and second blocking plate 62 on the cap 5 and attached with the first blocking plate 61. By the attachment of the first blocking plate 61 and the second blocking plate 62, the cap 5 can be prevented from shaking.

With reference now to FIG. 3, this figure shows the cross section view of a preferred embodiment of the present invention. As shown in FIG. 3, the sliding groove A is arranged on the left side of the base 1 such that the pivoting shaft 411, 412, 421, 422 of the first rack 41 and the second rack 42 can be engaged within the coupling parts 11 and 51 of the base 1 and the cap 5, respectively. The both ends of the elastic member 3 are attached to the bump 52 of the cap 5 and the conductive film 2. Moreover, the first blocking plate 61 on the base 1 is attached to the second blocking plate 62 on the cap 5. When the cap 5 is pressed down by user, the pivoting shafts 412, within the sliding groove and the tie 413 are moved toward one side. The cap 5 is therefore moved down to press the elastic member. The conductive pin 31 of the conductive film 2 within the elastic member 3 touches the conductive connection, thus forming conductive loop.

Figure 5A:
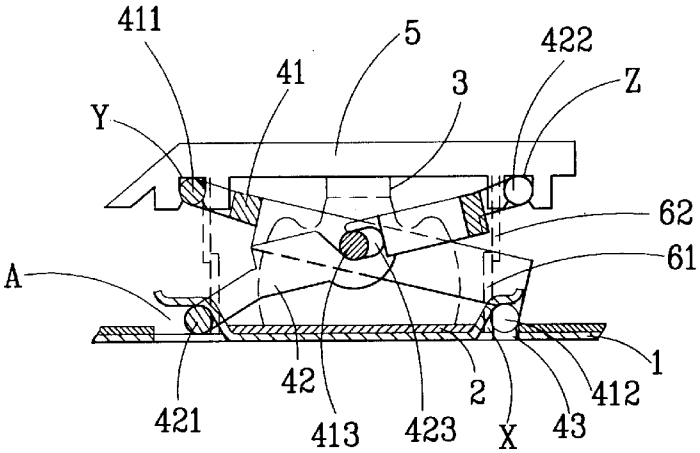
FIG. 5 is a cross-section view showing another embodiment of the present invention.
Figure 5B:
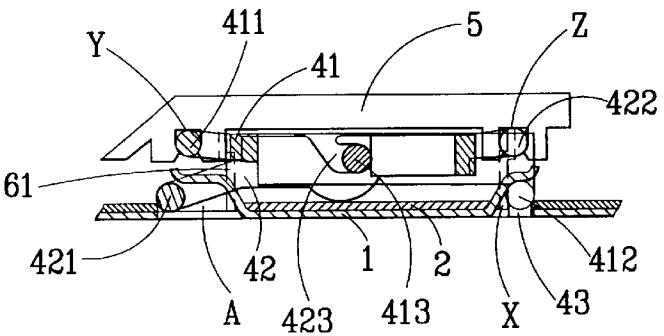

FIG. 5 shows another embodiment of the present invention. The sliding groove A is placed at the lower-left position, that is, the coupling part 11 on the left side of the base 1 is the sliding groove. The pivoting shaft 421 arranged on the left side the second rack 42 is slidable, the other pivoting shafts 411, 412 and 422 are not slidable. Therefore, the first and second rack 41 and 42 can be move downward.

Figure 6A:
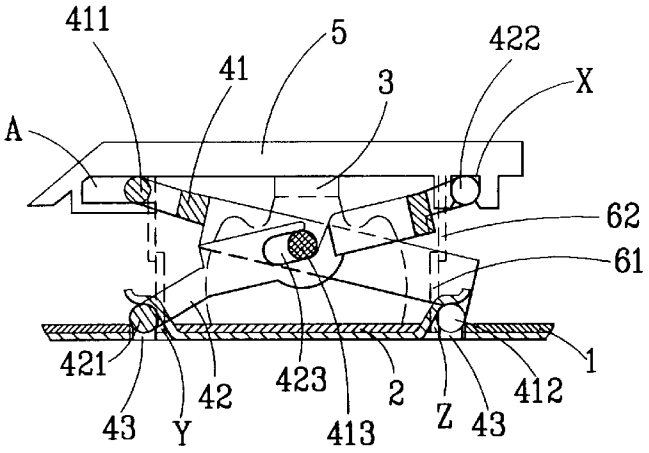
FIG. 6 is a cross-section view showing still another embodiment of the present invention.
Figure 6B:
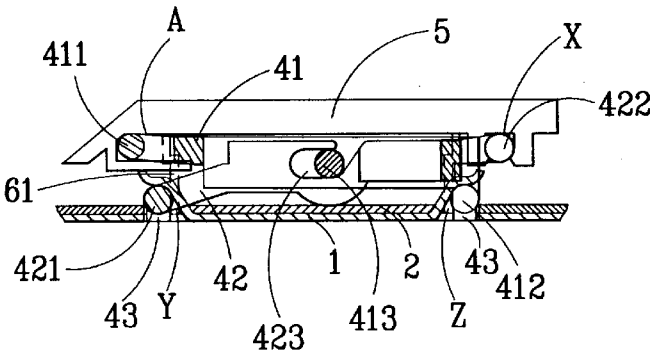
Figure 7A:
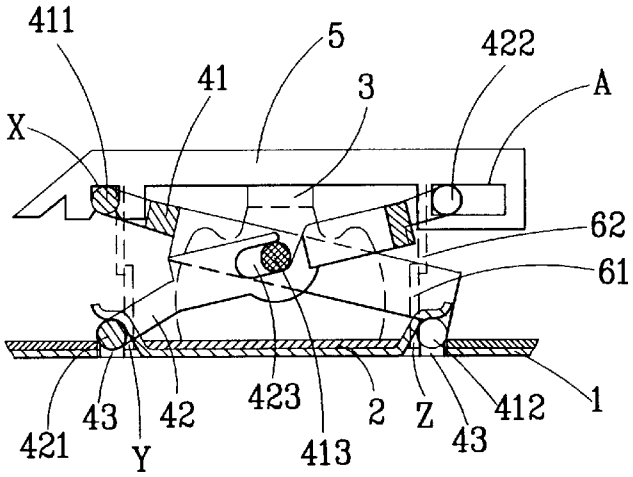
FIG. 7 is a cross-section view showing still another embodiment of the present invention.
Figure 7B:
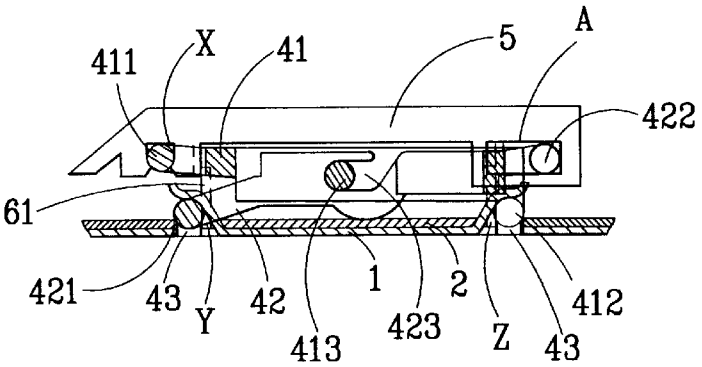
Figure 8:
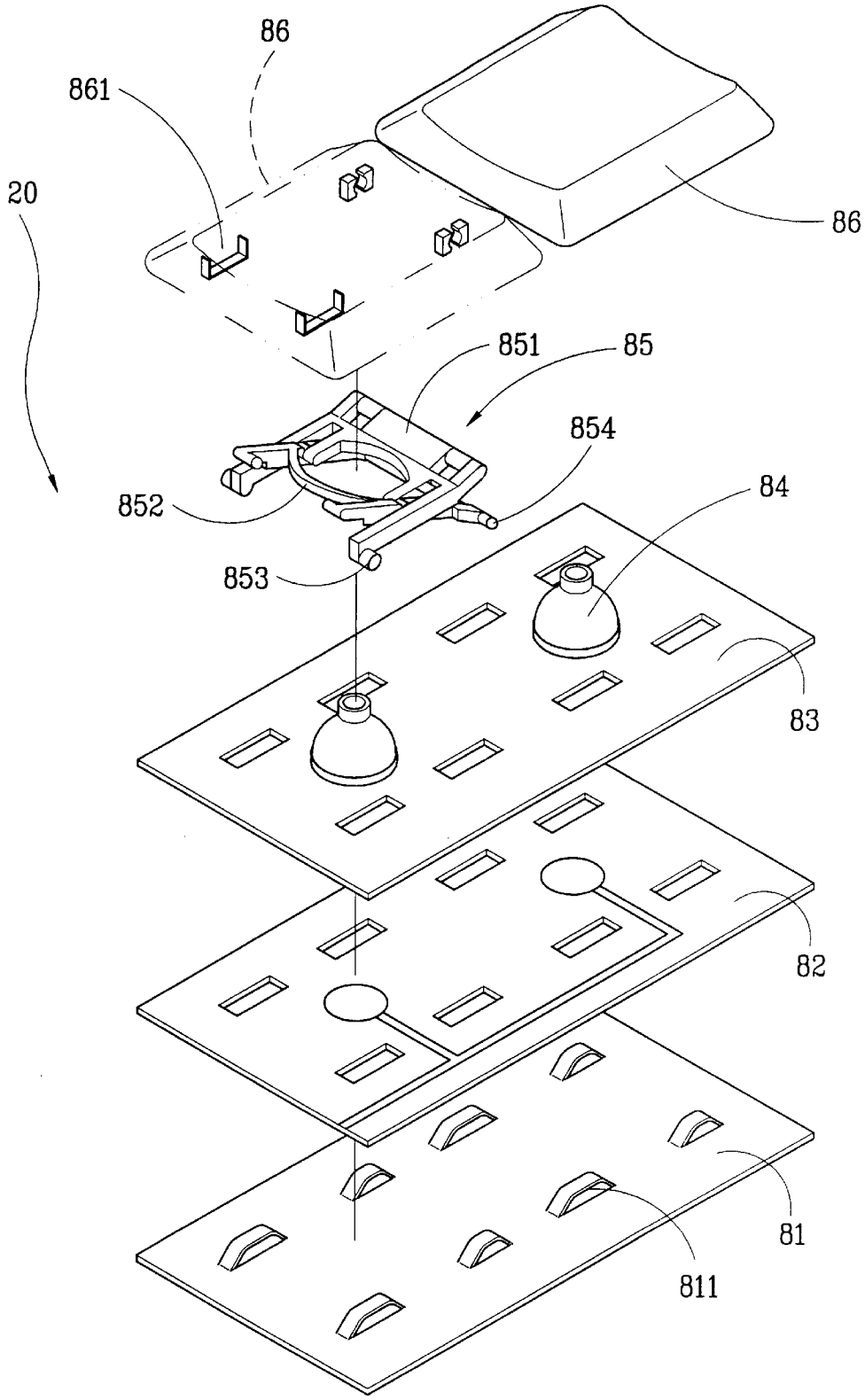
FIG.8 PRIOR ART
FIG. 8 is an exploded view of a conventional key.

FIG. 6 shows still another embodiment of the present invention. The sliding groove A is placed on the left side of the cap 5. That is, the coupling part 51 on the left side of the cap 5 is functioned as sliding groove A. The pivoting shaft 411 on the left side of the first rack 41 is slidable. Furthermore, FIG. 7 shows still another preferred embodiment of the present invention. The sliding groove A is designed to be on the right side of the cap 5. That is, the coupling part 51 on the right side of the cap 5 is functioned as the sliding groove. The pivoting shaft 422 on the right side of the second rack 42 is slidable.

In the present invention, a clamping means 6 is provided between the cap 5 and the base 1 such that the cap 5 will not shake when the key 10 is pressed. In other word; the key 10 can be stably pressed. The keyboard in the present invention does not adopt conventionally-used plastic plate, the assembling of the keyboard 10 is more convenient. Moreover, both end of the elastic member are attached between the bump 52 of the cap 5 and the conductive film 2. The elastic member 3 will not outleap when the keyboard 10 is disassembled.

Although the present invention has been described with reference to the preferred embodiment thereof, it will be understood that the invention is not limited to the details thereof Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A key of a computer keyboard, comprises:

a base having a plurality of coupling parts and a conductive film, an elastic member, a frame and a cap, wherein, said conductive film having a plurality of openings at respective locations corresponding to positions of said plurality of coupling parts of said base, each said coupling part projecting from a respective one of said openings when said conductive film is placed upon said base, said conductive film further having a circuit and an electric contact;

said frame having a first rack pivotably arranged with a second rack in cross relationship, both sides of the first rack and the second rack being provided with pivoting shafts;

said cap having a plurality of coupling parts, said pivoting shafts of the first rack and the second rack being respectively pivotably engaged with said coupling parts of said cap and said base;

said elastic member having opposing ends respectively connected to said conductive film and said cap, said elastic member having a conductive pin positioned in contact with said electric contact of said conductive film when said elastic member is pressed;

clamping means arranged between said base and said cap for preventing shaking of said cap when said key is pressed, said clamping means including (a) a pair of first blocking plates respectively extending upwardly from two sides of said base, and (b) a pair of second blocking plates respectively extending downwardly from two sides of said cap in correspondence with said pair of first blocking plates, each said second blocking plate being juxtapositioned in abutting relationship with a corresponding one of said first blocking plates.

2. The key as in claim 1, wherein said first rack is of U-shape, the closed end thereof having a pivoting shaft engaged into said coupling part on left side of said cap; the opened end thereof having outward extending pivoting shaft engaged into said coupling part on right side of said base, said second rack having pivoting shafts on both end thereof to engage into said coupling part on the right side of the cap and the left side of the base, respectively, said second rack having engaging groove at location corresponding to said tie of said first rack such that a tie is engaged into and moves laterally within said engaging groove.

3. The key as in claim 1, wherein the coupling part on the right side of said base is a sliding groove, and the coupling parts on the left side of said base, on the right and left side of said cap are fixed groove.

4. The key as in claim 1, wherein the coupling part on the left side of said base is a sliding groove, and the coupling parts on the right side of said base, on the right and left side of said cap are fixed groove.

5. The key as in claim 1, wherein the coupling part on the left side of said cap is a sliding groove, and the coupling parts on the right side of said cap, on the right and left side of said base are fixed groove.

6. The key as in claim 1, wherein the coupling part on the right side of said cap is a sliding groove, and the coupling parts on the left side of said cap, on the right and left side of said base are fixed groove.

7. The key as in claim 1 wherein said pivoting shafts adjacent a lower end of at least one of said first and second racks each have a blocking pole extending downwardly therefrom to extend into a respective one of a plurality of openings formed in said base in correspondence with said plurality of coupling parts of said base for preventing said pivoting shafts from disengaging from said coupling parts of said base.

* * * * *